US005421399A

United States Patent [19]

Thompson et al.

[11] Patent Number: 5,421,399

[45] Date of Patent: Jun. 6, 1995

[54] COOL/HEAT PUMP CONTROL CIRCUIT FOR A ROOM AIR CONDITIONER

[75] Inventors: Christopher M. Thompson, Nashville; David M. Jackson, Murfreesboro, both of Tenn.

[73] Assignee: Whirlpool Corporation, Benton Harbor, Mich.

[21] Appl. No.: 178,480

[22] Filed: Jan. 7, 1994

Related U.S. Application Data

[63] Continuation of Ser. No. 852,591, Mar. 17, 1992, abandoned.

[51] Int. Cl.[6] ..... F25B 29/00

[52] U.S. Cl. ..... 165/29; 62/160; 62/156; 62/277; 318/112

[58] Field of Search ..... 165/29; 62/160, 156, 62/277; 318/112

[56] References Cited

U.S. PATENT DOCUMENTS

| | | | |
|---|---|---|---|
| 3,006,613 | 10/1961 | Coyne | 165/29 |
| 3,404,729 | 10/1968 | Armott et al. | 165/29 |
| 3,537,509 | 11/1970 | Ferdelman | 165/29 |
| 3,666,002 | 5/1972 | Ferdelman | 165/29 |
| 3,766,973 | 10/1973 | DeGrella, Jr. et al. | 165/26 |
| 3,799,245 | 3/1974 | Ferdelman | 165/29 |
| 3,831,663 | 8/1974 | Pithie | 165/26 |
| 4,146,086 | 3/1979 | Hobbick et al. | 165/25 |
| 4,228,846 | 10/1980 | Smorol | 165/2 |
| 4,311,190 | 1/1982 | Walley | 165/25 |
| 4,373,350 | 2/1983 | Noland | 165/29 |
| 4,418,744 | 12/1983 | Sidebottom | 165/25 |
| 4,550,770 | 11/1985 | Nussdorfer et al. | 165/29 |
| 5,022,460 | 6/1991 | Brown | 165/12 |
| 5,131,455 | 7/1992 | Tsuchiyama et al. | 165/29 |
| 5,165,249 | 11/1992 | Thompson | 62/160 |

FOREIGN PATENT DOCUMENTS

| | | | |
|---|---|---|---|
| 0139252 | 10/1979 | Japan | 165/29 |

OTHER PUBLICATIONS

Aero Met II, brochure, Aerovox Electrical products Group 740 Belleville Ave New Bedford Mass. 02745-6194 (Aug. 1991).

*Primary Examiner*—John K. Ford
*Attorney, Agent, or Firm*—Thomas J. Roth

[57] ABSTRACT

A control circuit for a cool/heat pump in which two separate motors are utilized, each with a main winding and an auxiliary winding. A single dual rated capacitor is provided in series with both auxiliary windings. A selectively operative switch, which may be in the form of a thermostat, is provided in series between one of the alternating current lines and the windings of one of the motors to selectively terminate power to that motor while maintaining power to both windings of the other motor. The switch is also used to alternately energize an electric heater unit when the motor power is terminated. Such a control circuit avoids a de-icing operation normally required with cool/heat pumps working in a heating mode, when the outdoor temperature is below freezing.

20 Claims, 4 Drawing Sheets

COOL/HEAT PUMP CONTROL CIRCUIT FOR A ROOM AIR CONDITIONER

This is a continuation of application Ser. No. 07/852,591, filed Mar. 17, 1992, now abandoned.

BACKGROUND OF THE INVENTION

The present invention relates to a control circuit and more specifically to a control circuit for a cool/heat pump room air conditioner.

Room air conditioners are well known and are of the type that generally fit in a window or in a sleeved opening formed through the wall of a room. Most such room air conditioners utilize a fluid refrigerant which is caused to alternately expand and condense to provide the desired cooling effect inside the room and to expel heat outside of the room. The refrigerant flows through a system which includes an evaporator where liquid refrigerant is permitted to evaporate thereby cooling a coil surface of the evaporator in order to extract heat from air within the room. A fan is used to cause room air to flow over the coil of the evaporator. The refrigerant then flows to the compressor where it is returned to a high pressure gas state. The refrigerant then flows to a condenser, generally positioned outside of the room wherein the refrigerant vapor condenses and gives off heat. Generally a fan is also provided on the condenser side to provide a flow of outside air over the condenser coil to remove heat therefrom. Refrigerant then flows to an expansion device where it is turned to a low pressure liquid state before flowing again to the evaporator.

It is known that by reversing the flow through the system, the air conditioner can act as a heat pump to draw heat from exterior of the room and to provide that heat to the interior of the room. In such an arrangement the refrigerant flow is reversed and what was the evaporator now acts as the condenser to release heat and what was the condenser now acts as the evaporator to absorb heat from the surrounding air.

Control systems for room air conditioners are well known and in such control circuits generally include a switch for powering a compressor motor and a fan motor as well as sometimes controlling other components.

Generally the type of motors utilized in such air conditioners have both a main winding and an auxiliary winding with capacitors in series with the auxiliary winding. Control circuits which have been provided for such air conditioning units and motors are disclosed in the following U.S. Pat. Nos. 2,242,370; 2,782,351; 3,045,159; 3,146,387; 3,385,077; and 3,852,648. Such circuits are limited to air conditioner units, however, and do not appear to provide the necessary controls for heat pump operation.

The above listed patents describe various types of control circuits and including circuits in which a single, dual rated capacitor is used in series with each of the two motor auxiliary windings.

In applications where a room air conditioner is also being utilized as a heat pump to provide indoor heating, additional considerations arrived over those necessary for controlling a room air conditioner, that is, the need to be assured that the evaporator does not develop an exterior coating of ice since this severely deteriorates the efficiency of the device.

In order to avoid a separate de-icing circuit for periodically de-icing the evaporator coil, the device embodying the present invention utilizes a separate electric heater which is utilized when the outdoor temperature is such that the outdoor heat exchanger is about to frost over.

Since it is still necessary for the fan motor to operate when the electric heater is operating, but when the motor driven compressor is not operating, it is necessary to sometimes operate the one motor at full power while the other motor is off.

SUMMARY OF THE INVENTION

The present invention provides a control circuit for a cool/heat pump room air conditioner which utilizes a minimum number of circuit parts, including only a single dual rated capacitor to control both the compressor motor and the fan motor, the control circuit providing means for terminating power to the compressor motor while maintaining power the auxiliary winding and main winding of the fan motor. The means for terminating power to the compressor motor is an outdoor thermostat switch which also controls an electric heater. Thus, when the thermostat detects a condition which would cause icing of the evaporator, the switch changes positions, terminating power to the compressor motor and providing power to the electric heater unit. The interior fan continues to operate since the electric heater unit is positioned adjacent to the interior heat exchanger unit.

DESCRIPTION OF THE PREFERRED EMBODIMENTS

Figure 1:
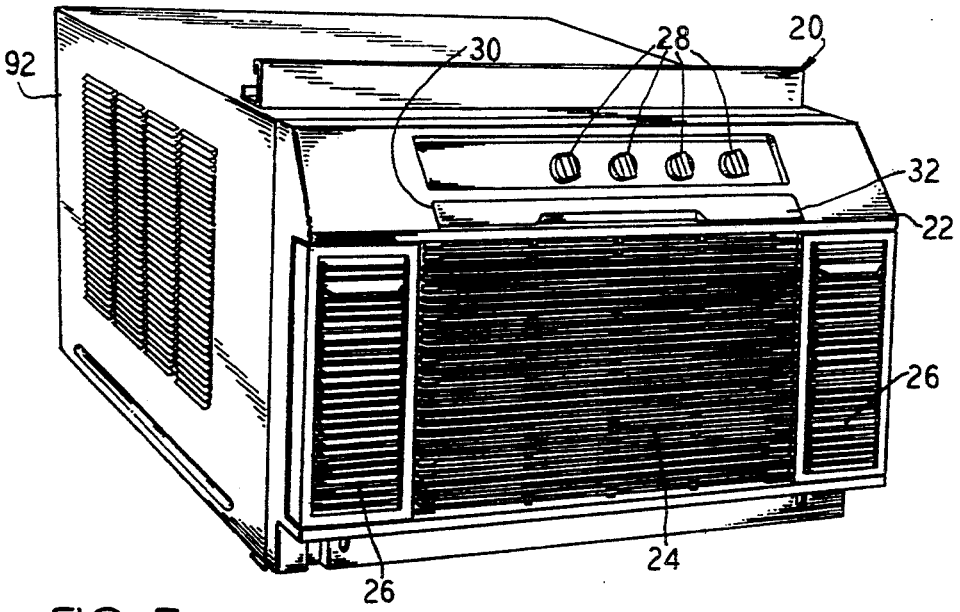
FIG. 1 is a perspective view of a cool/heat pump room air conditioner embodying the principles of the present invention.

FIG. 1 illustrates a cool/heat pump room air conditioner generally at 20 which embodies the principles of the present invention. Although the present invention may be utilized in other circuits where two motors are to be controlled, it has particular utility in a cool/heat pump room air conditioner and will be described in that environment.

The cool/heat pump room air conditioner has a front panel 22 which faces the interior of a room to be cooled or heated when the cool/heat pump unit is placed in an open window or in a through the wall sleeve. A central portion 24 of the panel constitutes an air inlet grill through which air flows into a portion of the cool/heat pump unit. The air is returned to the room through a pair of laterally spaced outlet grills 26.

A plurality of controls 28 are provided on a control panel area above the inlet grill. Positioned above the inlet grill 24 and below the controls is a slot 30 within which is received an air filter element 32.

Figure 2:
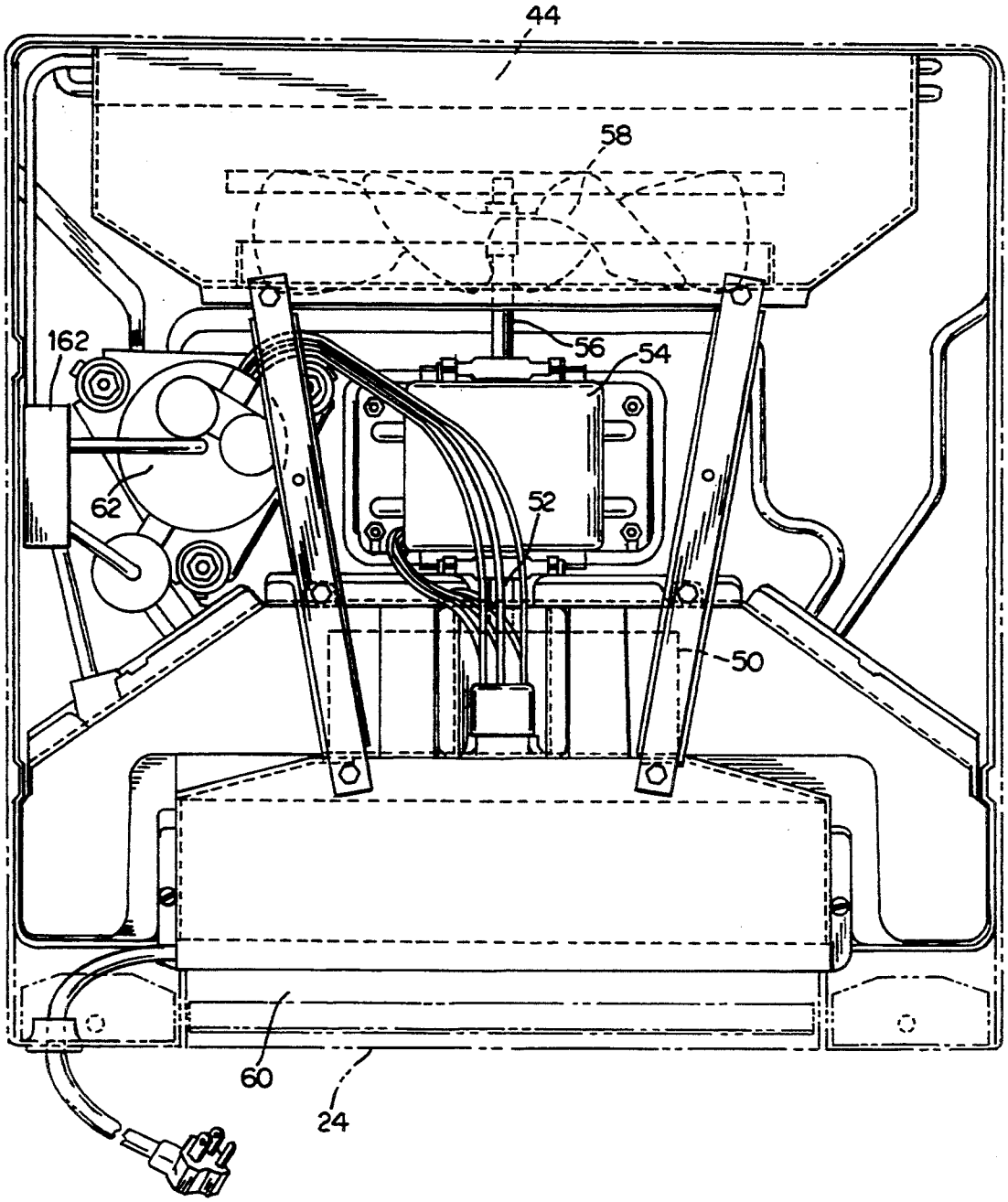
FIG. 2 is a top elevational view of the cool/heat pump of FIG. 1 with the cover removed.
Figure 3:
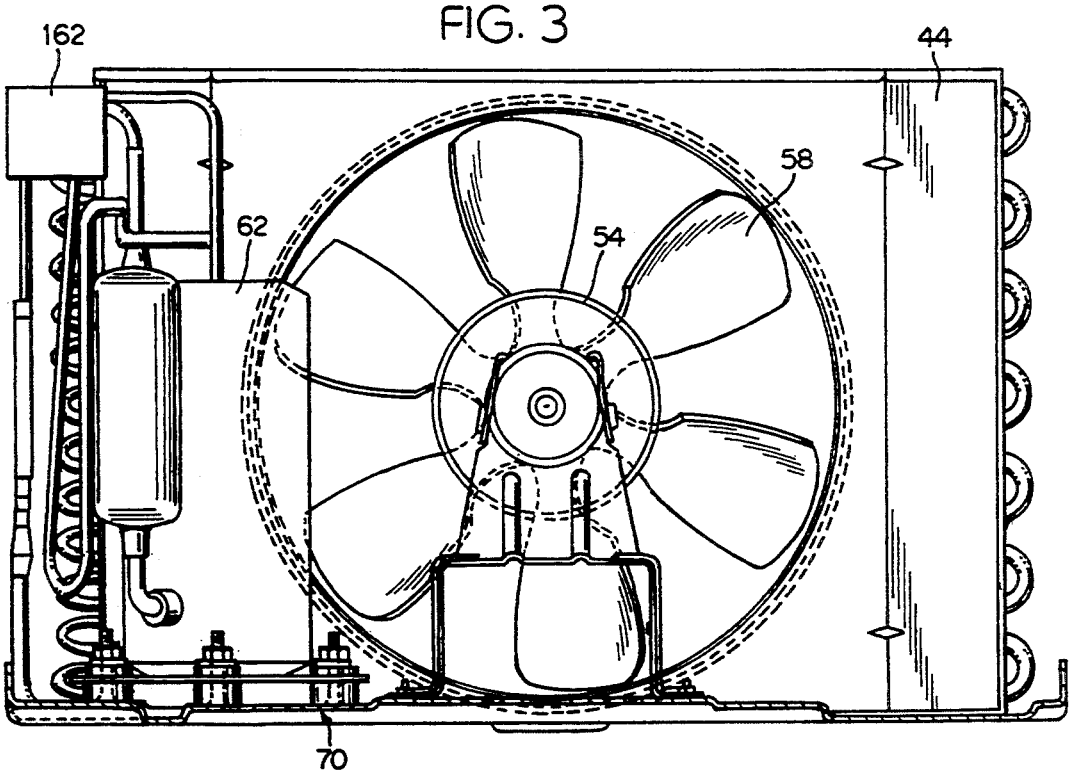
FIG. 3 is a sectional view through a central portion of the cool/heat pump showing the "exterior" side of the unit.
Figure 4:
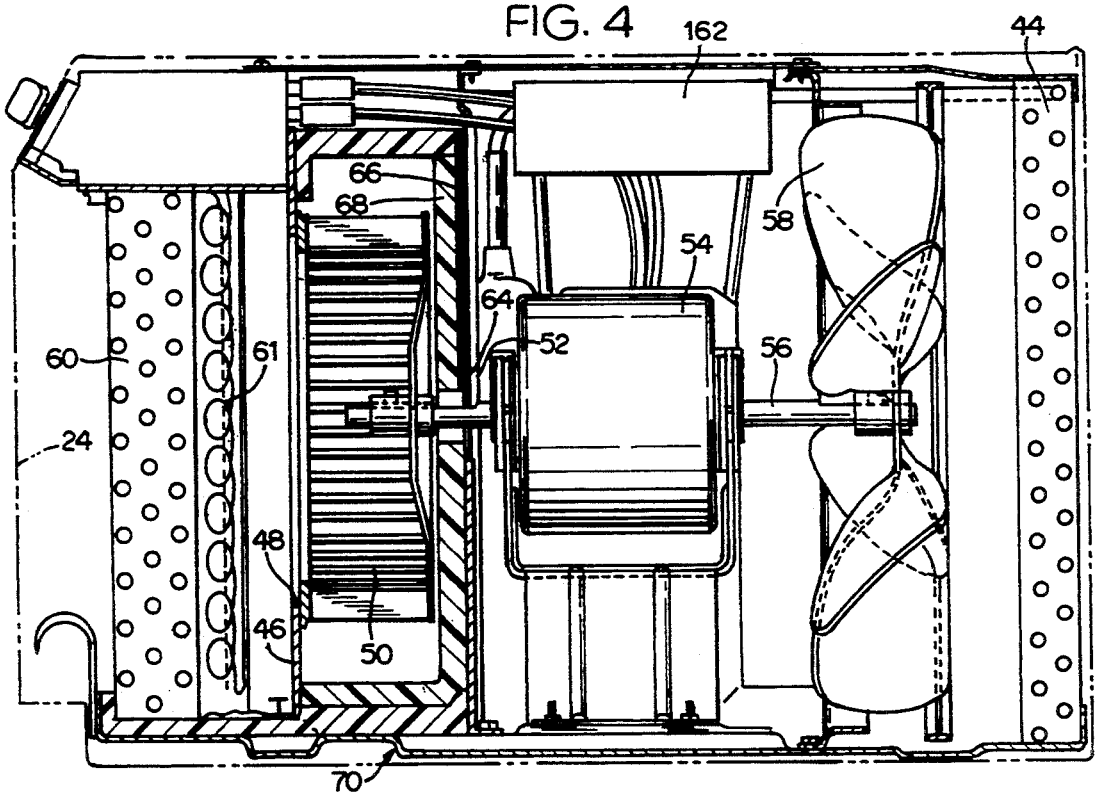
FIG. 4 is a side sectional view of the cool/heat pump of FIG. 1.

The internal components of the cool/heat pump unit are shown in greater detail in FIGS. 2–4. Directly behind the front inlet grill is located a first heat exchange unit 60 and an electric heater unit 61 which are mounted within a sheet metal shroud or housing 46. The housing 46 has central rear opening 48 which is positioned directly in front of an air moving device, preferably a blower wheel. The blower wheel 50 is mounted on a forwardly extending drive shaft 52 of an electric motor 54. The motor 54 also has a rearwardly extending drive shaft 56 to which a fan blade 58 is mounted. The drive shafts 52, 56 extend along the center line of the cool/heat pump unit. Directly behind the fan blade is a second heat exchanger 44. A compressor 62 is provided as is known in the art.

The forwardly extending drive shaft 52 extends through an opening 64 in a barrier wall 66 provided between the blower wheel 50 and the motor 52. The barrier wall 66 separates the two heat exchange units 44, 60 to prevent a short circuiting of the thermal effects generated by the unit. A barrier of expanded polystyrene 68 is provided along the barrier wall 66 which provides an insulation against heat transfer.

A base pan assembly 70 is provided as a mounting platform for a large number of the components of the cool/heat pump unit.

Figure 5:
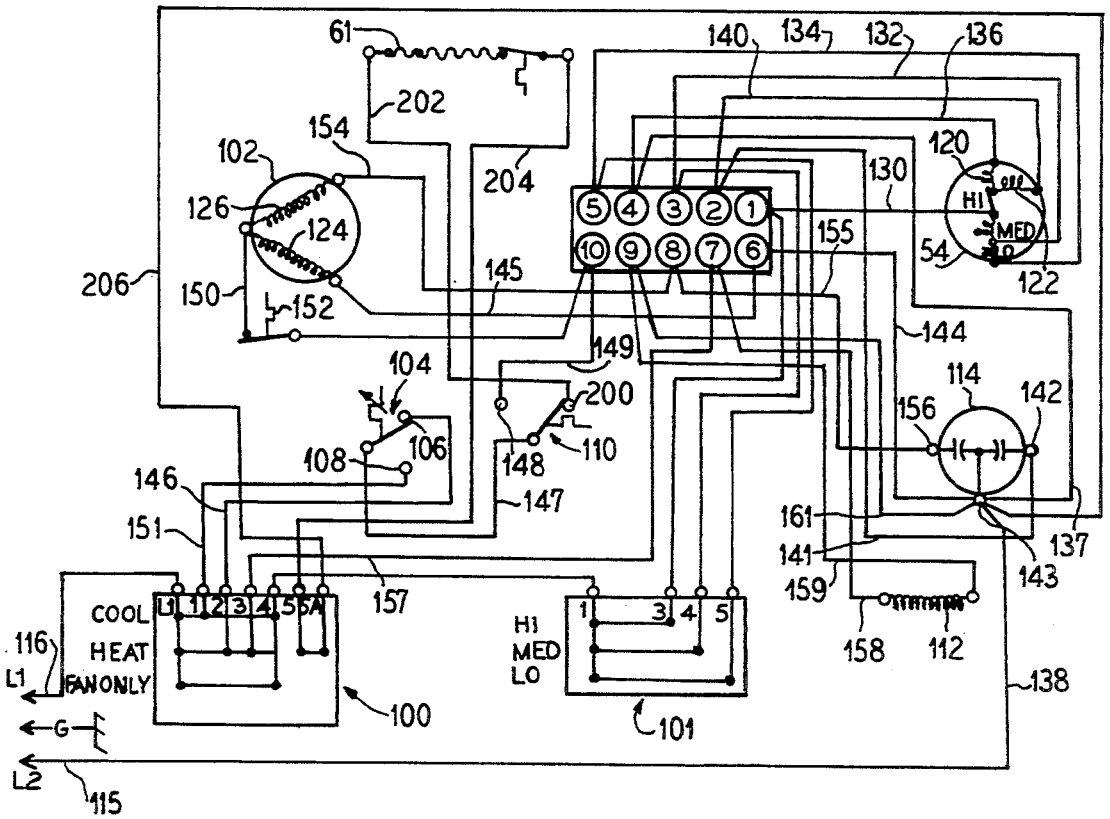
FIG. 5 is an electrical schematic of the control circuit for the cool/heat pump.

A control circuit for the cool/heat pump is illustrated in FIG. 5. Control switches 100, 101 which may be two of the controls 28 on the front panel of the unit shown in FIG. 1 are provided for the user to select an operating mode for the cool/heat pump. The illustrated operating modes include three speeds (switch 101) each of heating and cooling, a fan only operating mode and an off mode. Other components of the circuit include the fan motor 54, a motor 102 for the compressor 62, an adjustable indoor thermostat 104 having an upper temperature contact 106 and a lower temperature contact 108, an outdoor thermostat 110, a solenoid 112 and a single dual rated capacitor 114. Single phase alternating current is provided to the circuit on a pair of lines 115, 116. Fan motor 54 has a main winding 120 and an auxiliary winding 122 and the compressor motor 102 also has a main winding 124 and an auxiliary winding 126.

Alternating current line 116 is connected to the main and auxiliary windings 120, 122, 124, 126 through the control switches 100, 101 and appropriate contacts therein. For the connection to the fan motor auxiliary winding 122, the alternating current line 116 is connected to a selected one of lines 130, 132, 134 depending upon whether the fan is to be run at a high, medium or low speed as selected by switch 101. Lines 130, 132 and 134 are connected to different taps in the auxiliary winding 122 of the fan motor. The fan motor main winding 120 is connected through lines 136, 137 and 138 to the alternating current line 115. The auxiliary winding 122 is connected through lines 140, 141 to a terminal 142 of the capacitor 114. A central terminal 143 of the capacitor 114 in turn is connected to the alternating current line 115 through line 138.

The compressor motor 102 main winding 124 is connected to the alternating current line 115 through lines 138, 144 and 145. During a heating mode of operation, when the outdoor temperature is still above freezing (0° C.), the connection from line 116 to the compressor main winding 124 is through switch 100, line 146, upper temperature contact 106 of the indoor thermostat 104, then through line 147 to upper temperature contact 148 in outdoor thermostat 110 and finally through lines 149 and 150.

During cooling operation, alternating current line 116 is connected to the compressor main winding 124 through line 151, lower temperature contact 108 of the indoor thermostat 104, then again through line 147 to upper temperature contact 148 in outdoor thermostat 110 and finally through lines 149 and 150. An overload fuse 152 is provided in line 150 to protect the compressor motor 102.

The compressor auxiliary winding 126 is connected to line 116 in precisely the same manner as the main winding 124 since they have a common terminal. The auxiliary winding 126 is also connected through lines 154, 155 to a second terminal 156 of capacitor 114 which, again, is then connected directly to alternating current line 115 at its center terminal.

Figure 6:
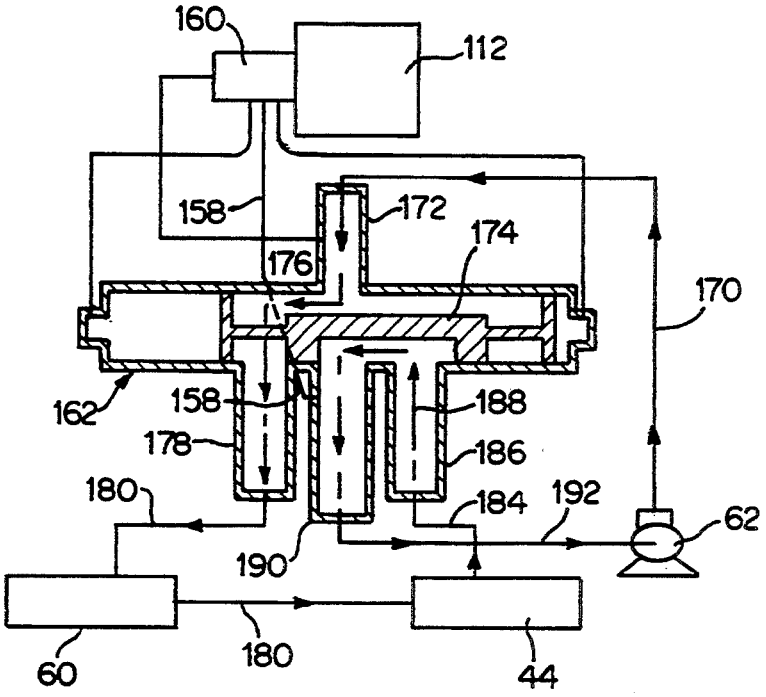
FIG. 6 is a schematic diagram of the refrigerant system with a reversing valve in a heating position.
Figure 7:
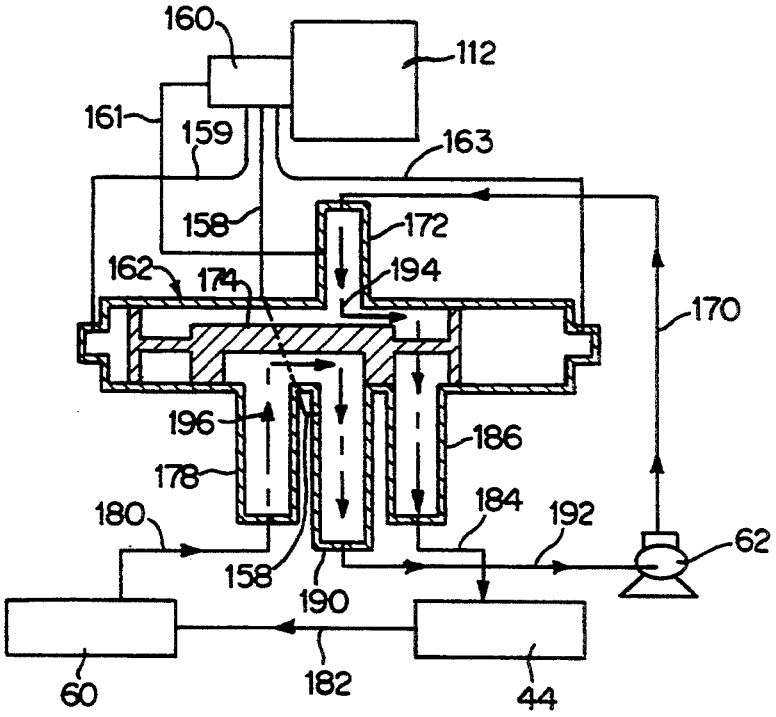
FIG. 7 is a schematic illustration of the refrigerant system with a reversing valve shown in a cooling position.

Solenoid 112 is energized when switch 100 is operated to select a heating mode. Current from line 116 flows to the switch 100 and then out on lines 157 and 158 to the solenoid coil 112. The current flows on lines 159, 161 and 138 to alternating current line 115. Solenoid 112 operates a pilot valve 160 as best seen in FIGS. 6 and 7. The pilot valve in turn is connected to a main valve 162 which provides for reversing flow of refrigerant through the system. Specifically, the compressor 62 is utilized to compress a refrigerant and to pump it, under high pressure, through line 170. Line 170 connects to an inlet port 172 on valve 162. In the position of valve 162 in FIG. 6 where a valve slide member 174 has been moved to a right hand position by the pilot valve 160, the refrigerant follows a flow path 176 to an outlet port 178 from where it flows through line 180 to heat exchange unit 60. In this arrangement heat exchange unit 60 acts as a condenser to reject heat to the surrounding air. The refrigerant condenses from a gas to a liquid in heat exchange unit 60.

From heat exchange unit 60 the refrigerant flows through line 182 to the second heat exchange unit 44 which, in this operating mode, acts as an evaporator where the now liquid refrigerant evaporates to a gas and absorbs heat from the surrounding air. From the second heat exchange unit 44 the now gaseous refrigerant flows through line 184 to a second inlet port 186 of valve unit 162 and along a flow path 188 to a second outlet port 190 of the valve member 162. From outlet port 190 the low pressure gaseous refrigerant flows through line 192 to a suction inlet on the compressor 62.

In a second position of solenoid 112, the pilot valve 160 is moved to a second position thus permitting its suction connection line 158 to be connected with line 159, and its pressure connection line 161 to be connected with line 163 to draw the slide member 174 to a left most position. Again, the compressor 62 operates in the same fashion and causes a flow of high pressure gaseous refrigerant through line 170 to inlet port 172. The refrigerant now flows on flow path 194 to what is now an outlet port 186 and through line 184 to the heat exchange unit 44. Now heat exchange unit 44 acts as a condenser rejecting heat to the surrounding atmosphere. The now liquid refrigerant flows through line 182 to the second heat exchange unit 60 which, in this mode of operation, functions as an evaporator to return the refrigerant to a gaseous state. The now low pressure liquid flows through line 180 through what is now an inlet port 178, along flow path 196 to outlet port 190, and through line 192 to again return to the suction side of the compressor 62.

In the heating mode selected by selector switch 100, the solenoid 112 is energized and thus causes the slide member 174 of valve 162 to move to the right most position as shown in FIG. 6. In this condition the heat exchange unit 60, which is positioned towards the interior of the room, acts as the condenser and gives off heat to the room. Heat is absorbed into the refrigerant in heat exchange unit 44 which is positioned on the exterior of the room.

During certain heating operating conditions (such as when the outdoor temperature is below freezing (0° C.), it is possible for the coils of the exterior heat exchange unit 44 to become coated with ice due to condensation of moisture in the outside air on to the coils which have a temperature below freezing. This condition is not desireable in that it severely impairs the efficiency of the outside heat exchange unit 44. Therefore, the outdoor thermostat 110 is provided to detect such outdoor temperature to remove power to the compressor motor 102 and instead direct power to the electric heater unit 61.

When such a temperature condition is detected, the thermostat 110 causes a disconnection from upper temperature contact 148 and a connection to lower temperature contact 200 to direct electrical current along line 202 to the electric heater unit 61. The electric heater unit 61 is then connected by line 204 to switch 100, then by lines 206 and 138 to alternating current line 115. Since this heating operation occurs while the interior of the room is to be heated, it is desireable to have the fan motor 54 operating although it is required to have the compressor motor 102 not operating. Thus, when the outdoor thermostat detects an exterior freezing temperature condition, the compressor motor windings 124, 126 are de-energized. The main and auxiliary windings 120, 122 of the fan motor 54 continue to be energized.

The use of a single dual rated capacitor 114 in the circuit to power both motors, yet to allow one motor to be completely de-energized while the other is fully energized significantly reduces the complexity of the circuit and reduces its cost in the reduction of components and in assembly time.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The embodiments of the invention in which an exclusive property or privilege is claimed are defined as follows:

1. A cool/heat pump operated by alternating current supplied on two lines comprising:

a compressor driven by an electric motor with a main winding and an auxiliary winding;

a condenser having a fluid flow connection to said compressor for a refrigerant fluid to flow from said compressor to said condenser to release heat to the atmosphere surrounding said condenser;

an evaporator having a fluid flow path connection to said condenser for said refrigerant fluid to flow from said condenser to said evaporator to absorb heat from the atmosphere surrounding said evaporator and a fluid flow path connection to return said refrigerant to said compressor;

an electric heater unit;

a fan driven by an electric motor with a main winding and an auxiliary winding for causing a flow of atmospheric air over at least one of said evaporator, heater unit and condenser;

a selector switch for a user to use in selecting an operating mode for the cool/heat pump, from the group comprising of a heating mode in which one side of the heater unit is connected to electrical power and a cooling mode in which said one side is disconnected from electrical power;

an indoor thermostat operatively connected to a first of said alternating current lines to selectively energize said compressor motor in both said heating mode and said cooling mode when a sensed outdoor temperature is above a preselected value and to connect a second side of said heater unit to electrical power when the sensed outdoor temperature is below the preselected value;

a single dual rated capacitor connected between a second of said alternating current lines and both said fan motor auxiliary winding and said compressor motor auxiliary winding;

a solenoid for use in selectively changing the flow direction of said refrigerant fluid in said flow path so as to cause said evaporator and condenser to change their function to that of the other, said solenoid being operatively connected to said selector switch to provide for selective energization thereof;

an outdoor thermostat operatively connected to said first of said alternating current lines, through said indoor thermostat to selectively alternately energize said compressor motor and said electric heater unit in said heating mode above and below a selected outdoor temperature value, respectively, said outdoor thermostat operating to disconnect power to the second side of said electric heater unit unless either a heating mode has been selected by a user or a cooling mode has been selected by a user and the sensed temperature at said outdoor thermostat is below the preselected value;

whereby, said compressor will operate in a heating mode only during temperatures above said selected value to prevent frosting of said evaporator and a single capacitor can be used in conjunction with two separate motors, yet allowing only one of said motors to run during certain conditions, while maintaining full power to said other motor in said cool/heat pump.

2. A cool/heat pump according to claim 1, wherein said outdoor thermostat switches operation between said compressor and electric heater unit at approximately 0° C.

3. A cool/heat pump according to claim 1, wherein said solenoid is connected to operate a valve in said fluid flow connections to cause a change in direction of said fluid flow.

4. A cool/heat pump according to claim 1, wherein said selector switch has switch positions to provide an operating mode of energizing only the fan motor to the exclusion of the compressor motor.

5. A cool/heat pump according to claim 1, wherein said electric heater unit is positioned adjacent to the component which functions as a condenser when said cool/heat pump is in said heating mode.

6. A cool/heat pump according to claim 5, wherein said fan comprises a single fan positioned so as to cause a flow of atmospheric air over both said electric heater unit and said component which functions as a condenser when said cool/heat pump is in said heating mode.

7. A control circuit for a cool/heat pump, said control circuit powered by alternating current supplied on two lines and said cool/heat pump using a refrigerant fluid, wherein said cool/heat pump comprises means for compressing said fluid, said means having an inlet and an outlet, a first heat exchanger having a fluid flow path connection to said outlet for said fluid to flow to said first heat exchanger, a second heat exchanger having a fluid flow path connection to said first heat exchanger for said refrigerant fluid to flow from said first heat exchanger to said second heat exchanger and a fluid flow path connection to return said refrigerant to said inlet, an electric heating unit, and a fan for causing a flow of atmospheric air over at least one of said two heat exchangers and said heating unit, said control circuit comprising:

an electric motor with a main winding and an auxiliary winding for driving said means for compressing said fluid;

a second electric motor with a main winding and an auxiliary winding for driving said fan;

a single dual rated capacitor connected between a second of said lines and both said fan motor auxiliary winding and said compressor motor auxiliary winding;

circuit means for selectively changing a flow direction of said refrigerant fluid in said flow path;

circuit means for terminating power to said compressor motor when providing power to said heating unit without also terminating power to said fan motor;

a first switch to disconnect power to one side of said electric heating unit unless a heating mode has been selected by a user;

a second switch, which is responsive to a sensed temperature, connected between a second side of said heating unit and a third switch when the sensed temperature is below a preselected value and connected between said compressor motor and a third switch when the sensed temperature is above the preselected value; and said third switch disconnecting power to a second side of said electric heating unit unless either a heating mode has been selected by a user or a cooling mode has been selected by a user and the sensed temperature at said second switch is below the preselected value.

8. A control circuit according to claim 7, wherein said first heat exchanger is a condenser.

9. A control circuit according to claim 7, wherein said second motor drives two fans to cause a flow of atmospheric air over both of said heat exchangers.

10. A control circuit according to claim 7, wherein said circuit means for selectively changing said fluid flow direction comprises a solenoid selectively controlled by a selector switch for a user to use in selecting an operating mode for the cool/heat pump, from the group comprising of a heating mode and a cooling mode.

11. A control circuit according to claim 7, wherein said circuit means for selectively terminating power to said compressor motor comprises a thermostat.

12. A control circuit according to claim 11, wherein said thermostat senses the temperature adjacent to one of said heat exchangers.

13. A control circuit according to claim 7, including a selector switch for a user to use in selecting an operating mode for the Cool/heat pump, from the group comprising a heating mode and a cooling mode.

14. A control circuit according to claim 10, wherein said solenoid is connected to operate a valve in said fluid flow connection to cause a change in direction of said fluid flow.

15. A control circuit according to claim 7, wherein said circuit means for selectively terminating power to said compressor motor is connected to said compressor motor windings so as to terminate power to both windings.

16. An electric circuit comprising:

two electric motors, each having a main winding and an auxiliary winding:

an electric heating unit;

one dual rated capacitor having a central connection and two termination connections;

a pair of alternating current lines;

a first one of said lines being connected to said main and auxiliary windings and a second of said lines being connected to said central connection;

said two terminal connections being connected to said first line in series with the respective auxiliary windings of said two motors;

a selectively operative switch in series between said first line and said main and auxiliary windings of a first of said motors and said electric heating unit to terminate power to said first motor, while maintaining power to the main and auxiliary windings of said other motor and while providing power to said electric heating unit;

a first switch to disconnect power from said second line to said electric heating unit unless a heating mode has been selected by a user;

said selectively operative switch, which is responsive to a sensed temperature, connects through a second switch said first line to said heating unit when the sensed temperature is below a preselected value and connects, through a second switch, said first line and said compressor motor when the sensed temperature is above the preselected value; and said second switch disconnecting power from said first line to said electric heating unit unless either a heating mode has been selected by a user or a cooling mode has been selected by a user and the sensed temperature at said selectively operative switch is below the preselected value.

17. An electric circuit according to claim 16, wherein said circuit is used in a cool/heat pump having a fan and a compressor and said first motor drives said compressor.

18. An electric circuit according to claim 17, wherein said cool/heat pump further comprises an evaporator and said selectively operative switch means comprises a thermostat associated with said evaporator.

19. An electric circuit according to claim 16, wherein said first of said alternating current lines is connected to said main winding of said first of said motors in series with a second selectively operative switch.

20. An electric circuit according to claim 19, wherein said first and second selectively operative switches comprise thermostats.

* * * * *